US006550468B1

(12) United States Patent
Tippmann, Jr.

(10) Patent No.: US 6,550,468 B1
(45) Date of Patent: Apr. 22, 2003

(54) TRIGGER ASSIST MECHANISM AND METHOD

(75) Inventor: Dennis J. Tippmann, Jr., Fort Wayne, IN (US)

(73) Assignee: Tippmann Pneumatics, Inc., Fort Wayne, IN (US)

( * ) Notice: Subject to any disclaimer, the term of this patent is extended or adjusted under 35 U.S.C. 154(b) by 0 days.

(21) Appl. No.: 09/844,008

(22) Filed: Apr. 27, 2001

(51) Int. Cl.[7] ..... F41A 19/00; F41B 11/00
(52) U.S. Cl. ..... 124/71; 124/31
(58) Field of Search ..... 124/31, 71, 72, 124/73; 89/129.01

(56) References Cited

U.S. PATENT DOCUMENTS

| | | | | |
|---|---|---|---|---|
| 3,650,174 A | | 3/1972 | Nelsen | |
| 3,854,231 A | | 12/1974 | Broyles | |
| 4,067,131 A | | 1/1978 | Ruger et al. | |
| 4,067,309 A | | 1/1978 | Wohrstein | |
| 4,384,422 A | | 5/1983 | Röh | |
| 4,602,608 A | | 7/1986 | Lacam et al. | |
| 4,819,609 A | | 4/1989 | Tippmann | |
| 4,936,282 A | | 6/1990 | Dobbins et al. | |
| 5,280,778 A | * | 1/1994 | Kotsiopoulos | 124/31 |
| 5,349,938 A | | 9/1994 | Farrell | |
| 5,462,042 A | | 10/1995 | Greenwell | |
| 5,503,137 A | | 4/1996 | Fusco | |
| 5,613,483 A | | 3/1997 | Lukas et al. | |
| 5,669,369 A | | 9/1997 | Scott | |
| 5,704,342 A | | 1/1998 | Gibson et al. | |
| 5,711,286 A | | 1/1998 | Petrosyan et al. | |
| 5,722,383 A | | 3/1998 | Tippmann, Sr. et al. | |
| 5,857,280 A | | 1/1999 | Jewell | |
| 5,890,479 A | | 4/1999 | Morin | |
| 5,913,303 A | | 6/1999 | Kotsiopoulos | |
| 6,142,137 A | * | 11/2000 | MacLaughlin | 124/32 |

FOREIGN PATENT DOCUMENTS

| | | | |
|---|---|---|---|
| EP | 0 440 428 A2 | | 1/1991 |
| EP | 0 440 428 B1 | | 1/1991 |
| EP | 0 440 428 A3 | | 1/1991 |
| EP | 0 467 089 A2 | | 6/1991 |
| EP | 0 467 089 A3 | | 6/1991 |
| JP | 09145296 A | * | 6/1997 |

* cited by examiner

*Primary Examiner*—Charles T. Jordan
*Assistant Examiner*—John W. Zerr
(74) *Attorney, Agent, or Firm*—Barnes & Thornburg

(57) ABSTRACT

A gun having a trigger assist mechanism that includes a chamber, a trigger having a firing position and a released position, a compressed gas source in pneumatic communication with the chamber, and an actuator in pneumatic communication with the chamber. The compressed gas source provides compressed gas to the chamber upon movement of the trigger to the firing position. The actuator is operably disposed to apply a force tending to move the trigger from the firing position to the released position when compressed gas is directed from the chamber to the actuator.

18 Claims, 4 Drawing Sheets

TRIGGER ASSIST MECHANISM AND METHOD

BACKGROUND AND SUMMARY OF THE INVENTION

The present invention relates to a gun, and particularly, to a pneumatically powered gun. More particularly, the present invention relates to gun having a trigger assist mechanism.

Pneumatically powered guns can be designed and manufactured to operate in single shot, semi-automatic, or fully automatic modes. They can also be provided with a selector that permits switching between two or more modes. A single shot gun necessitates that an operator pull a bolt back or otherwise load a projectile, and then pull a trigger to fire the projectile. In contrast, with each shot of a semi-automatic gun, the bolt is positioned to be ready for the next shot, and is therefore capable of firing projectiles as fast as the operator can pull the trigger. Even with this improved firing capacity, however, the speed of an operator's finger cannot equate with an automatic gun. Fully automatic guns do not require the trigger to be pulled with the firing of each projectile. When an operator pulls the trigger back, an automatic gun will continue to fire projectiles as fast as mechanically possible for the gun until the trigger is released.

Competitions and games have become popular for pneumatically powered guns. However, automatic guns are typically not permitted in such competitions and games. Therefore, it has become desirable in the pneumatically powered gun industry to provide a semi-automatic gun that permits rapid firing of a type associated with an automatic gun.

One embodiment of a gun constructed in accordance with the present invention includes a trigger assist mechanism. This embodiment includes a chamber having a projectile entrance and a projectile exit, a trigger having a firing position and a released position, a compressed gas source in pneumatic communication with the chamber, and an actuator in pneumatic communication with the chamber. The compressed gas source provides compressed gas to the chamber upon movement of the trigger to the firing position. The actuator is operably disposed to apply a force tending to move the trigger from the firing position to the released position.

In one embodiment, the actuator is a pneumatic piston. Compressed gas is directed to the pneumatic piston from the chamber upon movement of the trigger to the firing position.

In another embodiment, a controller is provided for cooperating with the actuator to control movement of the trigger from the released position to the firing position. The controller can be a bleed valve. The controller operates to adjustably control the release of compressed gas from the actuator. The controller includes an adjustment screw which is variable between a closed position and an open position, wherein the closed position restricts the exit flow of compressed gas from the actuator.

In another embodiment, an apparatus is provided for controlling the movement of a trigger on a gun. According to this embodiment, the apparatus includes a chamber for firing a projectile from the gun using a propellant, a trigger having a firing position and a released position, and an actuator in pneumatic communication with the chamber. The actuator is operably disposed to move the trigger from the firing position to the released position when the propellant is directed from the chamber to the actuator.

In yet another embodiment, a method of assisting movement of a trigger on a gun having a chamber for receiving a compressed gas to expel a projectile when the trigger is moved from a released position to a firing position is provided. The method includes the steps of: providing an actuator operably disposed to tend to move the trigger from the firing position to the released position when the actuator is filled with a compressed gas; providing a source of compressed gas to the chamber; and directing the compressed gas from the chamber to the actuator to assist in movement of the trigger. The subject method can further include the step of controllably releasing the compressed gas from the actuator such that the trigger can be moved from the released position to the firing position in response to a force acting on the trigger.

Other advantages and novel features of the present invention will become apparent from the following detailed description of the invention when considered in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
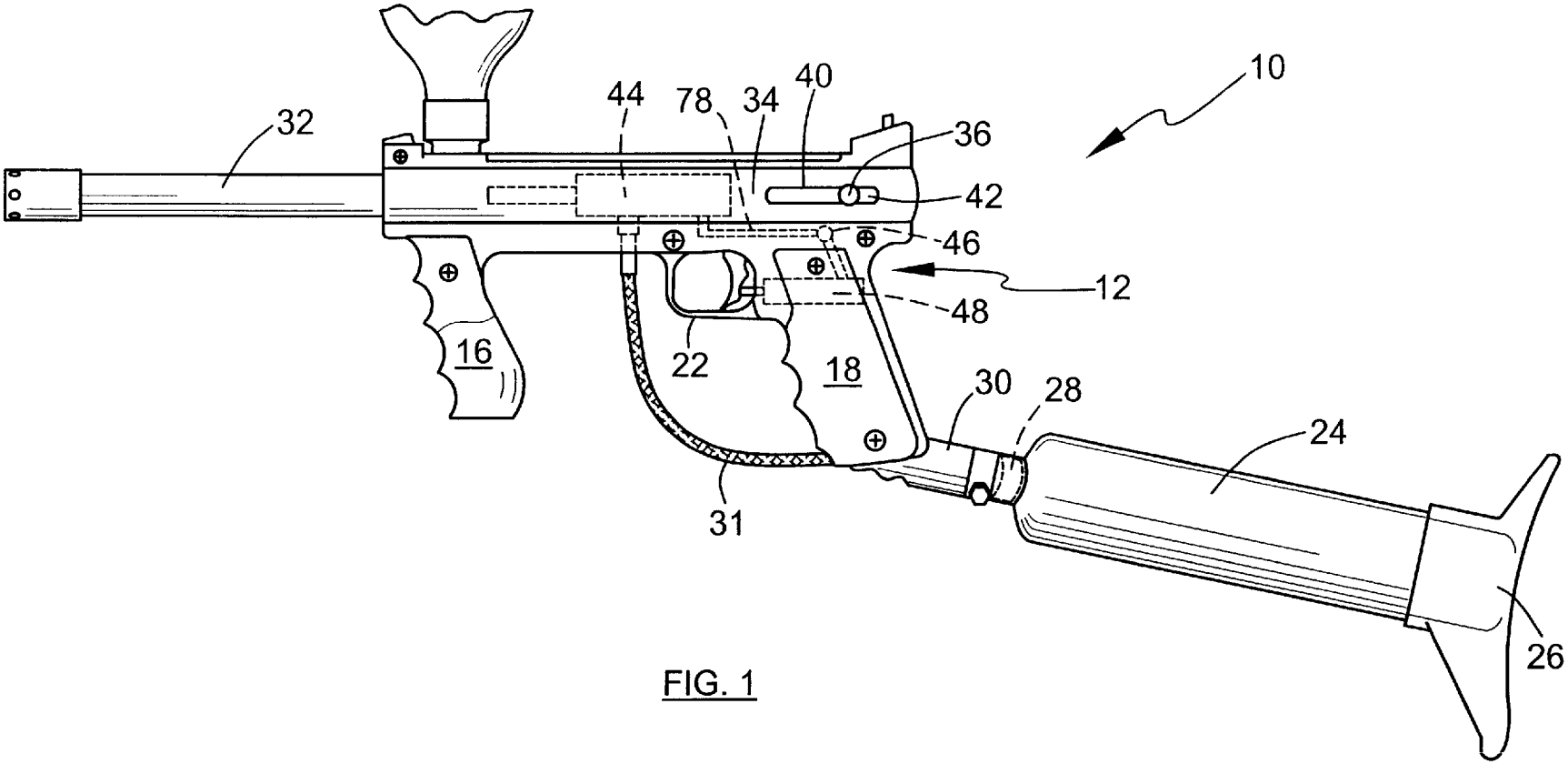
FIG. 1 is a side view of a gun equipped with an embodiment of the trigger assist mechanism constructed in accordance with the present invention.

FIG. 1 shows a perspective view of a gun 10 equipped with an embodiment of a trigger assist mechanism 12 constructed in accordance with the present invention. Gun 10 includes a front hand grip or forestock 16 and a pistol grip 18 both of which are used to hold gun 10 in a firing position.

Gun 10 additionally includes a firing mechanism, such as trigger 20, used to fire projectiles from gun 10. Trigger 20 is partially surrounded by a trigger guard 22. Gun 10 additionally includes a shoulder stock 24 and a buttplate 26. A $CO_2$ or other compressed gas canister forms shoulder stock 24 and is used as a propellant to fire projectiles from gun 10 and also operate the trigger assist mechanism 12, as discussed more fully below. As can be seen in FIG. 1, canister 24 includes a neck portion 28 that is received in a socket portion 30 (coupled with pistol grip 18) by such means as a threaded engagement between neck 28 and socket 30. Compressed gas feed tube 31 directs compressed gas from the canister 24 to the valve assembly 44, shown in phantom in FIG. 1.

Gun 10 further includes a barrel 32 from which projectiles are fired and a frame 34 to which components of gun 10, such as trigger assist mechanism 12, are attached. Gun 10 additionally includes a member 36 connected to a cyclically reciprocating bolt 38 (shown in FIGS. 3 and 4). Member 36 cyclically reciprocates within slot 40 formed in frame 34 of gun 10. Slot 40 includes an end 42 that receives member 36 when the reciprocating member of gun 10 is in a "cocked" or ready position for firing a projectile, as shown in FIGS. 1 and 4.

Figure 2:
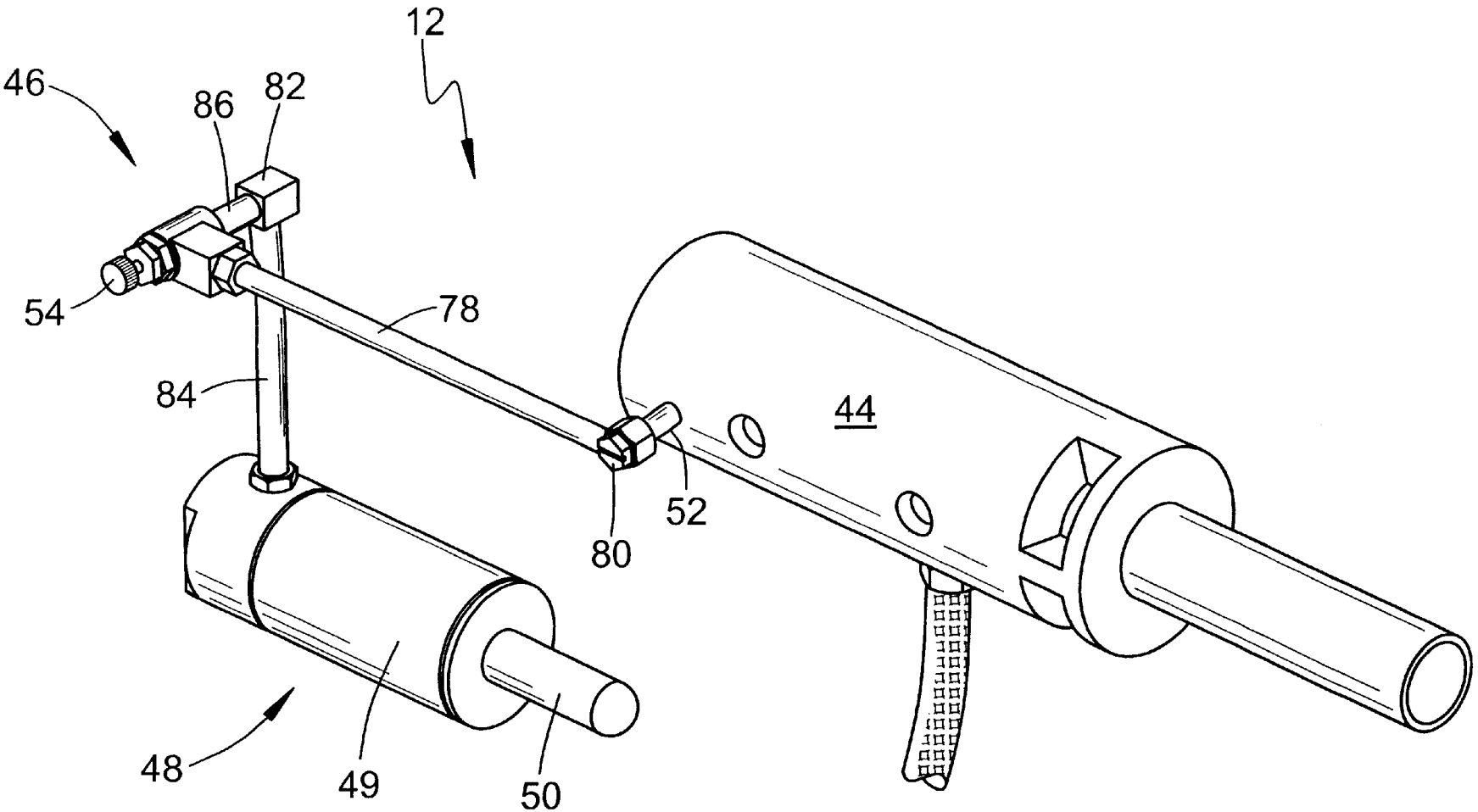
FIG. 2 is a perspective view of the trigger assist mechanism shown in FIG.

Elements of trigger assist mechanism 12 can be seen in FIG. 2. Trigger assist mechanism 12 includes an actuator 48 in pneumatic communication with valve assembly 44. Actuator 48, in one embodiment, comprises a cylindrical piston assembly 49 having an axially projecting rod 50. When compressed gas is directed from valve assembly 44 through port 52, it travels into actuator 48. In the piston embodiment disclosed above, rod 50 projects from cylindrical piston assembly 49 upon introduction of compressed gas into piston assembly 49. It should be understood that while the trigger assist mechanism 12 is described herein with relation to a pneumatic gun, the inventive elements could also be applied to any type of gun that uses a propellant, such as in the case of bullets having a combustible propellant, i.e. gun powder.

In one embodiment, trigger assist mechanism 12 further comprises a valve 46, which functions to permit the free flow of compressed gas toward actuator. 48, while variably controlling the release of the compressed gas from actuator 48. Variable control is established with screw 54, which permits flow of compressed gas away from actuator 48 that is proportional to the depth at which screw 54 is threaded into valve 46. Such a construction provides for controlled rate of depression of rod 50 into piston assembly 49 from the extended position, as will be discussed further below.

Figure 3:
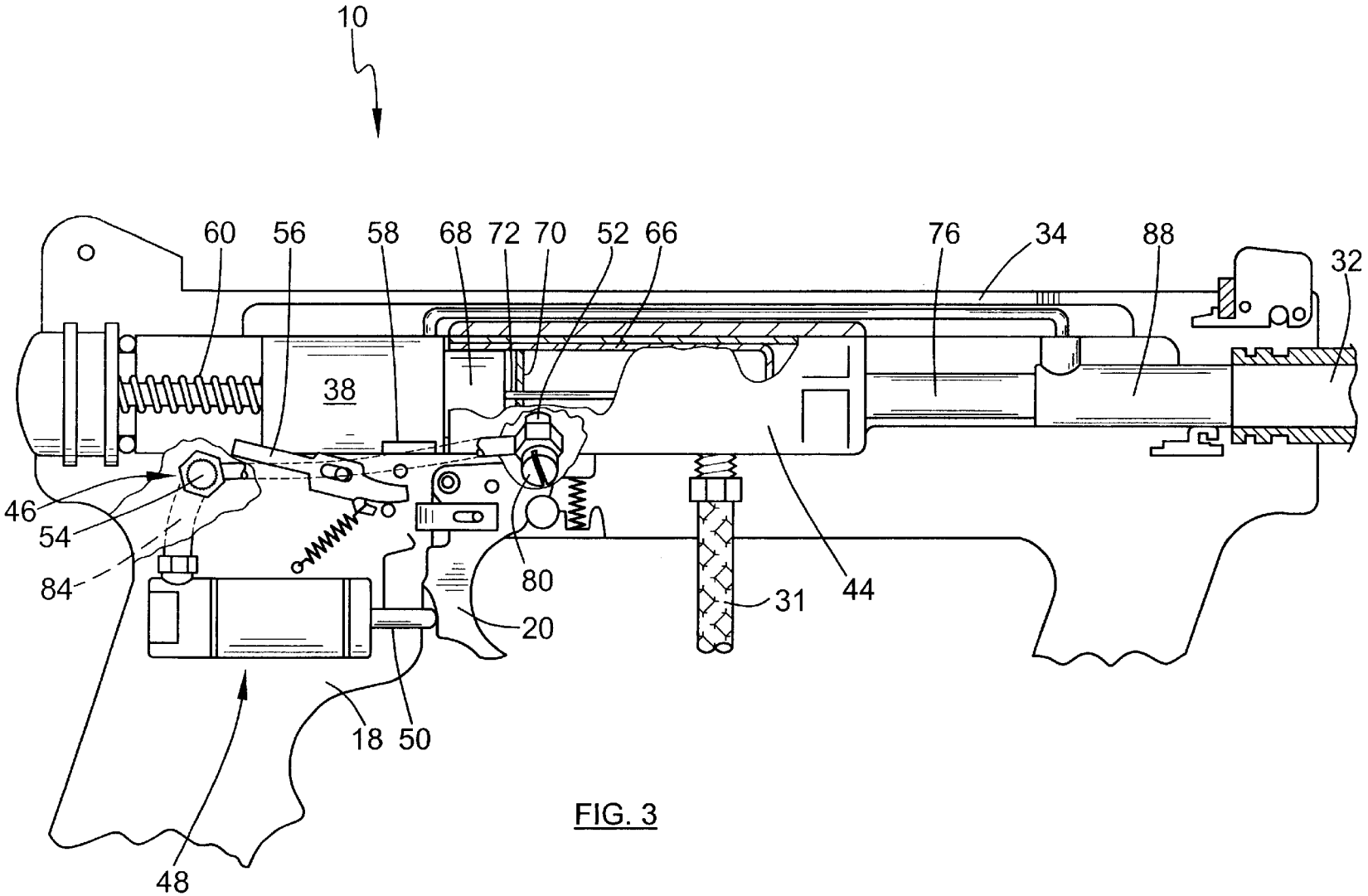
FIG. 3 is an assembled, cross-sectional side view of the trigger assist mechanism shown in FIG. 1.
Figure 4:
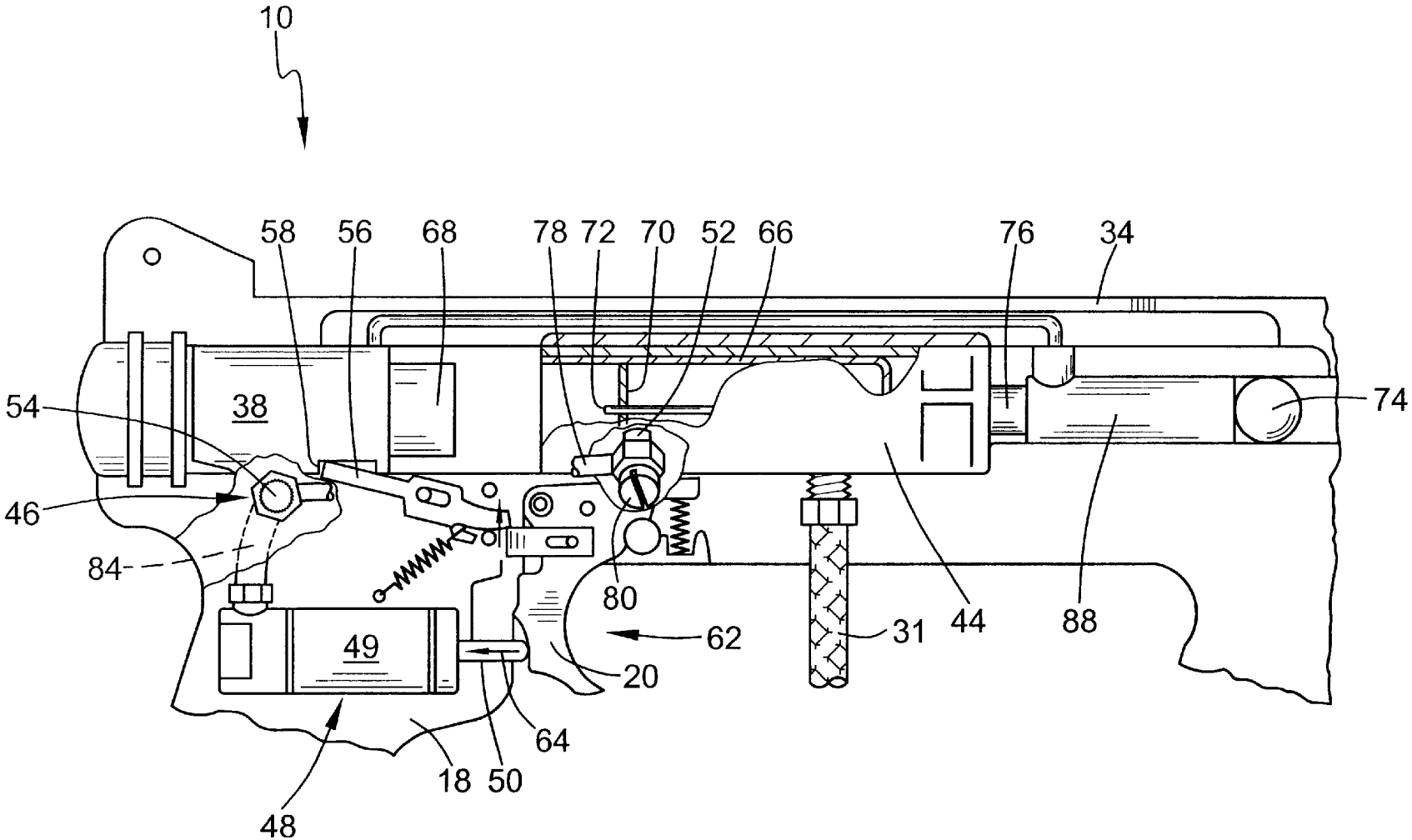
FIG. 4 is an assembled, cross-sectional side view similar to that of FIG. 3, showing the bolt in the recoiled stage, ready to be released with the actuation of the trigger.

A cut away view of the right side of gun 10 is shown in FIGS. 3–4. Actuator 48 is shown embodied in pistol grip 18 such that rod 50 is positioned to engage trigger 20 and is disposed for movement with trigger 20. In FIG. 4, bolt 38 is in the cocked (ready to be fired) position, and is held in place with sear 56, which engages a notch or shoulder portion 58 of bolt 38, thereby holding bolt 38 in place against movement caused by the urging of spring 60. Sear 56 is moved out of engagement with notch 58 upon actuation of trigger 20. In the embodiment illustrated, trigger 20 is manually pulled rearwardly toward grip 18 in the direction indicated by arrow 62 to pivot or move sear 56 out of engagement with notch or shoulder 58.

The pulling of trigger 20 in direction 62 also causes rod 50 to be urged in the direction indicated by arrow 64, thereby depressing rod 50 into cylindrical piston assembly 49. Gas in cylindrical piston assembly 49 is relieved through valve 46 at a rate controlled by screw 54. When screw 54 is in a tightened position, gas escapes at a slower rate from piston assembly 49. Consequently, rod 50 is slower to move into piston assembly 49 and trigger 20 is similarly slower to move in direction 62. Conversely, when screw 54 is in a loosened position, rod 50 moves more readily into piston assembly 49 under a similar urging pressure from trigger 20. Such an adjustment permits a similar urging pressure (in direction 62) on trigger 20 to have a variety of firing rates depending on the position of screw 54 relative to valve 46.

When sear 56 moves out of engagement with notch 58, bolt 38 moves forwardly under the urging of spring 60 (shown in FIG. 3) toward barrel 32. Valve assembly 44, which is fixedly mounted to frame 34, concentrically receives bolt 38 such that sleeve 66 circumscribes forward end 68 of bolt 38. As bolt 38 approaches rear wall 70 of valve assembly 44 under spring-loaded pressure from spring 60, bolt 38 impacts pin 72, which activates valve assembly 44. The activation of valve assembly 44 causes the release of compressed gas from canister 24 into valve assembly conduit 76 and eventually into barrel 32, there by propelling projectile 74 from the gun 10. As projectile 74 is propelled from gun 10, bolt 38 also simultaneously recoils under compressed gas pressure to the cocked position, as is known in the art.

When pin 72 is impacted, compressed gas is also directed through port 52 to valve 46 and into actuator 48. In one embodiment, as shown in FIGS. 1–4, a port conduit 78 pneumatically couples valve 46 with port 52, and a securing screw 80 secures port conduit 78 to port 52. The head of securing screw 80 is disposed outside of frame 34 to facilitate access to securing screw 80, as shown in cut-away view in FIGS. 3–4. Similarly, valve 46 is disposed outside of frame 34 for access to adjustment screw 54. In such an embodiment, port conduit 78, disposed between securing screw 80 and valve 46, is also disposed outside of frame 34.

Valve 46 is configured to pass through frame 34 at pass-through portion 86 (shown in FIG. 2), and couples with elbow 82, which permits direct routing of actuator conduit 84 between actuator 49 and pass-through portion 86 of valve 46.

Trigger assist mechanism 12 operates in cooperation with elements of gun 10 substantially as follows. When trigger 20 is pulled in direction 62, sear 56 releases notch 58 of bolt 38. Under spring-loaded pressure from spring 60, bolt 38 moves forwardly toward valve assembly 44 and pin 72. The impact of bolt 38 with pin 72 causes compressed gas to be released into barrel 32 to thereby propel projectile 74 from gun 10. The recoil forces delivered by the compressed gas also cause slide 88, which is mechanically connected with bolt 38, to be forced rearwardly. Such movement allows bolt 38 to again become engaged with sear 56, which catches notch 58 of bolt 38 until future disengagement caused by trigger 20.

Upon the pulling of trigger 20 in direction 62 and the release of compressed gas from valve assembly 44 as disclosed above, compressed gas is also directed through port 52 to trigger assist mechanism 12. In one embodiment, trigger assist mechanism 12 comprises actuator 48, which functions to move trigger 20 from a first firing position to a second released position when actuator 48 is energized with compressed gas directed from port 52. In the embodiment shown in FIGS. 1–4, actuator 48 comprises a cylindrical piston assembly 49 having a rod 50 configured to axially extend from the piston assembly 49 when energized with compressed gas directed from port 52. Subsequent to the energization of piston assembly 49, compressed gas is released from piston assembly 49 and trigger 20 is capable of being pulled in direction 62 again. Advantageously, trigger assist mechanism 12 allows a constant finger pressure to be applied to trigger 20 that can result in rapid reciprocation of trigger 20 between a firing position and a released position.

In another embodiment, actuator 48 further comprises valve 46 which permits variable release of compressed gas from piston assembly 49, as disclosed above. In this embodiment, piston assembly 49 releases the compressed gas at a rate controlled by adjustment screw 54, therefore controlling the reciprocation rate of trigger 20. Valve 46 permits free flow of compressed gas toward actuator 48, while permitting variable control of the reverse flow. Valve 46, for example, can be a Clippard Flow Control Valve, Part No. CS-2543, which permits variable control of the reverse flow rate with adjustment screw 54.

From the preceding description of the disclosed embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A pneumatic gun comprising:

a chamber having a projectile entrance and a projectile exit, a trigger having a firing position and a released position, a compressed gas source in intermittent pneumatic communication with the chamber, the compressed gas source providing compressed gas to the chamber upon movement of the trigger to the firing position, and an actuator in pneumatic communication with the chamber such that compressed gas is provided to the actuator upon movement of the trigger to the firing position, wherein the actuator is operably disposed to apply a force tending to move the trigger from the firing position to the released position.

2. The apparatus of claim 1, wherein the actuator is a pneumatic piston.

3. The apparatus of claim 2, wherein compressed gas is directed to the pneumatic piston from the chamber upon movement of the trigger to the firing position.

4. The apparatus of claim 1, further comprising a controller for cooperating with the actuator to control movement of the trigger from the released position to the firing position.

5. A pneumatic gun comprising:

a chamber having a projectile entrance and a projectile exit, a trigger having a firing position and a released position, a compressed gas source in pneumatic communication with the chamber, the compressed gas source providing compressed gas to the chamber upon movement of the trigger to the firing position, an actuator in pneumatic communication with the chamber, wherein the actuator is operably disposed to apply a force tending to move the trigger from the firing position to the released position, and a controller for cooperating with the actuator to control movement of the trigger from the released position to the firing position, wherein the controller is a bleed valve.

6. A pneumatic gun comprising:

a chamber having a projectile entrance and a projectile exit, a trigger having a firing position and a released position, a compressed gas source in pneumatic communication with the chamber, the compressed gas source providing compressed gas to the chamber upon movement of the trigger to the firing position, an actuator in pneumatic communication with the chamber, wherein the actuator is operably disposed to apply a force tending to move the trigger from the firing position to the released position, and a controller for cooperating with the actuator to control movement of the trigger from the released position to the firing position, wherein the controller adjustably controls a release of compressed gas from the actuator.

7. A pneumatic gun comprising:

a chamber having a projectile entrance and a projectile exit, a trigger having a firing position and a released position, a compressed gas source in pneumatic communication with the chamber, the compressed gas source providing compressed gas to the chamber upon movement of the trigger to the firing position, an actuator in pneumatic communication with the chamber, wherein the actuator is operably disposed to apply a force tending to move the trigger from the firing position to the released position, and a controller for cooperating with the actuator to control movement of the trigger from the released position to the firing position, wherein the controller includes an adjustment screw, the adjustment screw being variable between a closed position and an open position.

8. The apparatus of claim 7, wherein the closed position restricts an exit flow of compressed gas from the actuator.

9. An apparatus for controlling the movement of a trigger on a gun, the gun having an intermittently pressurized chamber for firing a projectile from the gun using a propellant, the trigger having a firing position and a released position, the apparatus comprising an actuator in pneumatic communication with the chamber, wherein the actuator is operably disposed to move the trigger from the firing position to the released position when propellant is directed from the intermittently pressurized chamber to the actuator.

10. The apparatus of claim 9, wherein the actuator is a pneumatic piston capable of being actuated with the propellant.

11. The apparatus of claim 10, wherein the propellant is directed to the pneumatic piston from the chamber upon movement of the trigger to the firing position.

12. The apparatus of claim 9, further comprising a controller for cooperating with the actuator to control movement of the trigger from the released position to the firing position.

13. An apparatus for controlling the movement of a trigger on a gun, the gun comprising:

a chamber for firing a projectile from the gun using a propellant, and a trigger having a firing position and a released position, the apparatus comprising an actuator in pneumatic communication with the chamber, wherein the actuator is operably disposed to move the trigger from the firing position to the released position when the propellant is directed from the chamber to the actuator, and a controller for cooperating with the actuator to control movement of the trigger from the released position to the firing position, wherein the controller is a bleed valve.

14. An apparatus for controlling the movement of a trigger on a gun, the gun comprising:

a chamber for firing a projectile from the gun using a propellant, and a trigger having a firing position and a released position, the apparatus comprising an actuator in pneumatic communication with the chamber, wherein the actuator is operably disposed to move the trigger from the firing position to the released position when the propellant is directed from the chamber to the actuator, and a controller for cooperating with the actuator to control movement of the trigger from the released position to the firing position, wherein the controller adjustably controls a release of the propellant from the actuator.

15. An apparatus for controlling the movement of a trigger on a gun, the gun comprising:

a chamber for firing a projectile from the gun using a propellant, and a trigger having a firing position and a released position, the apparatus comprising an actuator in pneumatic communication with the chamber, wherein the actuator is operably disposed to move the trigger from the firing position to the released position when the propellant is directed from the chamber to the actuator, and a controller for cooperating with the actuator to control movement of the trigger from the released position to the firing position, wherein the controller includes an adjustment screw, the adjustment screw being variable between a closed position and an open position.

16. The apparatus of claim 15, wherein the closed position restricts an exit flow of compressed gas from the actuator.

17. A method of assisting movement of a trigger on a gun, the gun having a chamber for receiving an intermittent flow of compressed gas to expel a projectile when the trigger is moved from a released position to a firing position, the method comprising the steps of:

providing an actuator operably disposed to tend to move the trigger from the firing position to the released position when the actuator is filled with compressed gas;

providing a source of compressed gas to the chamber; and directing the intermittent flow of compressed gas from the chamber to the actuator to assist in movement of the trigger.

18. A method of assisting movement of a trigger on a gun, the gun having a chamber for receiving a compressed gas to expel a projectile when the trigger is moved from a released position to a firing position, the method comprising the steps of:

providing an actuator operably disposed to tend to move the trigger from the firing position to the released position when the actuator is filled with compressed gas;

providing a source of compressed gas to the chamber;

directing the compressed gas from the chamber to the actuator to assist in movement of the trigger, and controllably releasing the compressed gas from the actuator such that the trigger can be moved from the released position to the firing position in response to a force acting on the trigger.

* * * * *